United States Patent [19]

Elsener

[11] 4,048,830

[45] Sept. 20, 1977

[54] FOUR-ROLLER SHEET BENDING MACHINES

[75] Inventor: Fritz Elsener, Nenzlingen, Switzerland

[73] Assignee: Chr. Hausler AG, Switzerland

[21] Appl. No.: 753,594

[22] Filed: Dec. 23, 1976

[30] Foreign Application Priority Data

Jan. 29, 1976 Switzerland ..... 1103/76

[51] Int. Cl.[2] ..... B21D 5/14

[52] U.S. Cl. ..... 72/175; 72/245

[58] Field of Search ..... 72/173–175, 72/170, 169, 245, 181

[56] References Cited

U.S. PATENT DOCUMENTS 2,870,817 1/1959 Boldrini ..... 72/175

3,704,616 12/1972 Taira ..... 72/175

*Primary Examiner*—Milton S. Mehr

*Attorney, Agent, or Firm*—McGlew and Tuttle

[57] ABSTRACT

The machine comprises a frame, a pair of nip rollers, two side-rollers disposed on respectively opposite sides of the nip rollers, and four pressure fluid operable devices each displaceably supporting a respective end portion of one of the side-rollers. Each pressure fluid operable device comprises a cylinder and a piston provided with a rod extending through one end portion of the respective cylinder to bear against the frame, the respective other end portion of each cylinder defining a housing provided with bearing means for the respective side-roller end portions and each cylinder being displaceably mounted in guide means.

3 Claims, 2 Drawing Figures

FOUR-ROLLER SHEET BENDING MACHINES

BACKGROUND OF THE INVENTION

The present invention relates to a four-roller sheet bending machine.

Such machines usually comprise a driven upper roller and a driven lower roller and two non-driven side-rollers disposed on respectively opposite sides of the pair of nip rollers formed by the upper and lower rollers. There are forms of construction, in which at least the side-rollers are displaceably journalled and in which displacing means for each side-roller are hydraulically actuable. FIG. 1 of the accompanying drawing shows a schematic side elevation of a known machine of this kind. At the foot of a side cheek element 1 of the frame of the machine, hydraulic cylinders 2 are each fastened by means of bolts 3 passing through lugs 2*a*. A piston 4 is connected by a piston rod 5 with a bearing block 6, which is guided between guides 7 and 8. An end portion 9 of the bearing block 6 is constructed as a bearing for one end portion 10 of the left-hand side-roller shown in FIG. 1. The respective other end portion of the left-hand side-roller is similarly supported. Moreover, the right-hand side-roller in FIG. 1 is supported in the same manner as the left-hand side-roller. As one can see from FIG. 1, the minimum overall dimensions of the machine side cheek elements, namely the width b, and the height h, and thus also their weight and, of course, within certain limits, also their cost, are determined by the magnitude and direction of the displacement of the side rollers as well as by the length of the bearing block 6 necessary for reasons of strength.

It is an object of the present invention to so alter this known construction that the cost of the materials required and the space occupied may each be substantially reduced.

SUMMARY OF THE INVENTION

According to the present invention there is provided a four-roller sheet bending machine comprising a frame, a pair of nip rollers, two side-rollers disposed on respectively opposite sides of the nip rollers, and four pressure fluid operable devices each displaceably supporting a respective end portion of one of the side-rollers, each device comprising a cylinder and a piston provided with a rod extending through one end portion of the respective cylinder to bear against the frame, the respective other end portion of each cylinder defining a housing provided with bearing means for the respective side-roller end portion, and each cylinder being displaceably mounted in guide means.

Thus, the bearing block of each bearing is constructed as part of an hydraulic cylinder, in other words, each bearing housing for the side-rollers is constructed not as the end portion of a bearing block but as the end portion of a hydraulic cylinder, which is displaceably mounted in a guide. Since with such a reversal of the hydraulic component, as apparently nobody has noticed up to now, the piston rod may be supported without difficulty quite simply on a cross-member of the frame, the length of the displacing members can thus be shortened substantially, so that smaller machine stands suffice for machines of equal performance, whereby material, weight, money and workshop space may be saved.

BRIEF DESCRIPTION OF THE DRAWINGS

An embodiment of the invention will now be more particularly described by way of example with reference to the accompanying drawing, in which.

DESCRIPTION OF THE PREFERRED EMBODIMENT

Figure 2:
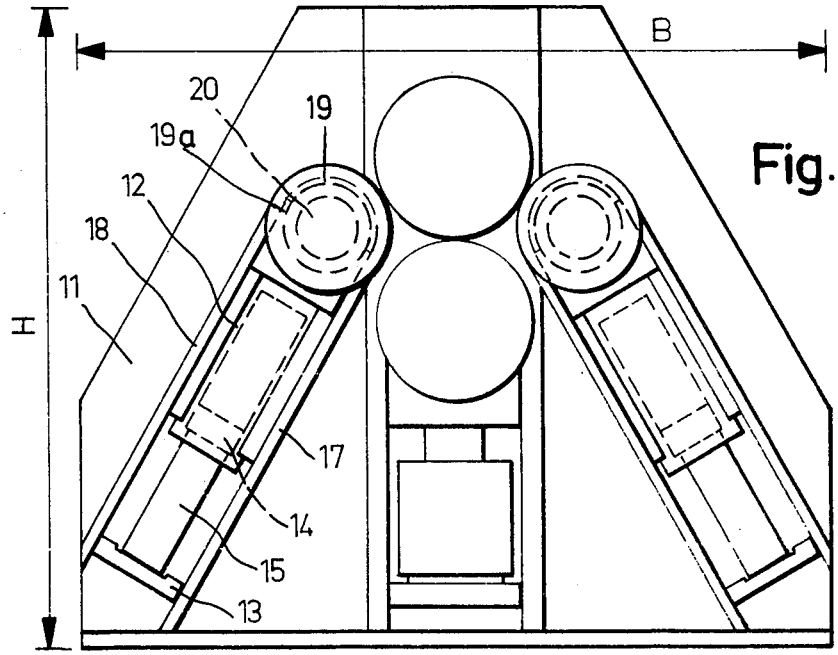
FIG. 2 shows a schematic side elevation of part of a four-roller bending machine embodying the present invention.

Referring now to FIG. 2 of the accompanying drawing, one side cheek element of the frame of a bending machine is indicated by the reference numeral 11. A hydraulic cylinder 12 of a pressure-fluid operable device is displaceably mounted between two guides 17 and 18. The hydraulic device also comprises a piston 14 which is provided with a piston rod 15. The lower end of the piston rod 15 in FIG. 2 freely abuts against a cross-beam 13. The cross-beam 13 is firmly secured to the cheek element 11 as well as to a cheek element (not shown) facing the element 11. The two guides 17 and 18 are also firmly secured to the cross-beam 13. The upper closed end portion in FIG. 2 of each cylinder 12, i.e. that cylinder end portion which is remote from that through which the piston rod 15 extends, is constructed as a divided housing 19 and is adapted to support a bearing 19*a* for the respective end portion of a side-roller 20, which is the left-hand side-roller in FIG. 2. The other end portion of the left-hand side-roller 20 is supported in a similar manner. Moreover, each end portion of the right-hand side-roller in FIG. 2 is also similarly supported. Each divided housing comprises two components which are mutually separable to provide access to the respective side-roller end portion.

Figure 1:
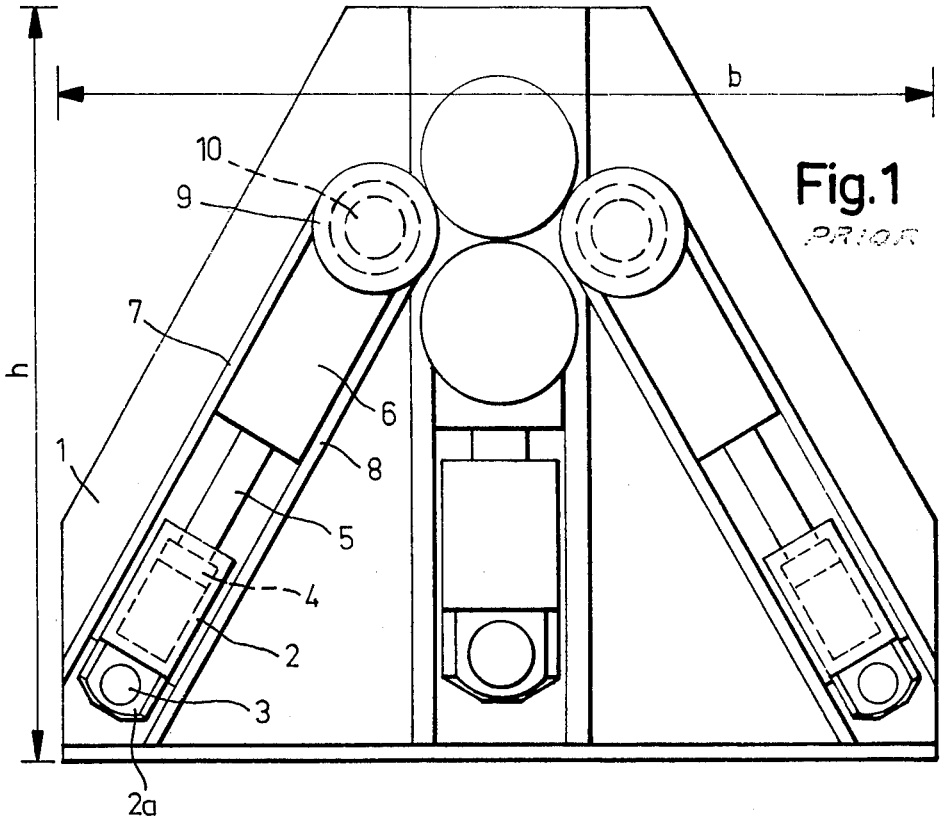
Fig.1 PRIOR ART
FIG. 1 shows a schematic side elevation of part of a known four-roller bending machine which has been referred to in the pre-amble.

As is evident from the drawing, the length of each of the pressure fluid operable devices may be shortened by a good 30% as a result of adopting the form of construction shown in FIG. 2, so that substantial cost savings may be obtained without any substantial consequent disadvantage having to be accepted. With otherwise equal dimensions, there results in FIG. 2 a reduction in the width of the machine cheek element, compared with the form of construction represented in the FIG. 1, by 15% to the new width B and a reduction in height by 14% to the new height H. Thus a 15% smaller base area and a 20% smaller frontal area of each cheek element may be obtained.

Due to the fact that the housings 19 are divided, the process of fitting or dismantling side-rollers provided with the bearings 19*a* is facilitated, which is useful for repair purposes.

I claim:

1. A four-roller sheet bending machine comprising, in combination:

a frame;

a pair of nip rollers;

two side-rollers disposed on respectively opposite sides of said nip rollers;

four pressure-fluid operable devices each displaceably supporting a respective end portion of one of said side-rollers, each said device comprisng a cylinder and a piston provided with a rod extending through one end portion of said cylinder to bear against said frame, the respective other end portion of each said cylinder defining a housing;

bearing means for the respective side-roller end portion provided in each housing; and respective guide means on said frame displaceably mounting each said cylinder.

2. A machine as defined in claim 1, wherein said other end portion of each cylinder defines a divided housing comprising two components mutually separable to provide access to said respective side-roller end portion.

3. A machine as defined in claim 1, wherein an end portion of each piston rod remote from said piston abuts freely against a member of the associated frame.

* * * * *